US005382050A

United States Patent [19]

Thompson

[11] Patent Number: 5,382,050

[45] Date of Patent: Jan. 17, 1995

[54] GAS GENERATOR FOR VEHICLE OCCUPANT RESTRAINT

[75] Inventor: Leif A. Thompson, Gilbert, Ariz.

[73] Assignee: TRW Inc., Lyndhurst, Ohio

[21] Appl. No.: 44,939

[22] Filed: Apr. 8, 1993

[51] Int. Cl.[6] ..... B60R 21/26

[52] U.S. Cl. ..... 280/741; 149/35; 280/728 R; 423/634

[58] Field of Search ..... 280/741, 728 R; 149/35; 423/634

[56] References Cited

U.S. PATENT DOCUMENTS

| | | | |
|---|---|---|---|
| 1,894,750 | 1/1933 | Baudisch | 423/634 |
| 2,244,758 | 1/1941 | Garner et al. . | |
| 2,560,970 | 1/1951 | Martin | 423/634 |
| 3,931,040 | 1/1976 | Breazeale | 280/741 |
| 4,243,443 | 1/1981 | Urtacki . | |
| 4,246,051 | 1/1981 | Garner et al. . | |
| 4,390,380 | 6/1983 | Camp . | |
| 4,604,151 | 8/1986 | Knowlton et al. . | |
| 4,698,107 | 10/1987 | Goetz et al. . | |
| 4,902,036 | 2/1990 | Zander et al. . | |

*Primary Examiner*—Eric D. Culbreth

*Attorney, Agent, or Firm*—Tarolli, Sundheim & Covell

[57] ABSTRACT

A vehicle occupant restraint assembly (12) has an inflatable vehicle occupant restraint (20), a housing (14), a gas generating material (16) within the housing, an igniter (18) for igniting the gas generating material, and gas flow channel (22) for directing the gas which is generated into the vehicle occupant restraint. The vehicle occupant restraint is preferably an air bag. The gas generating material (16) contains (a) an alkali metal azide, alkaline earth metal azide or aluminum azide and (b) a metal oxidant which is the gamma form of ferric oxide ($Fe_2O_3$). The metal oxidant is present in the gas generating composition in an approximately stoichiometric amount with regard to the metal azide, or in an amount slightly in excess of stoichiometric.

7 Claims, 1 Drawing Sheet

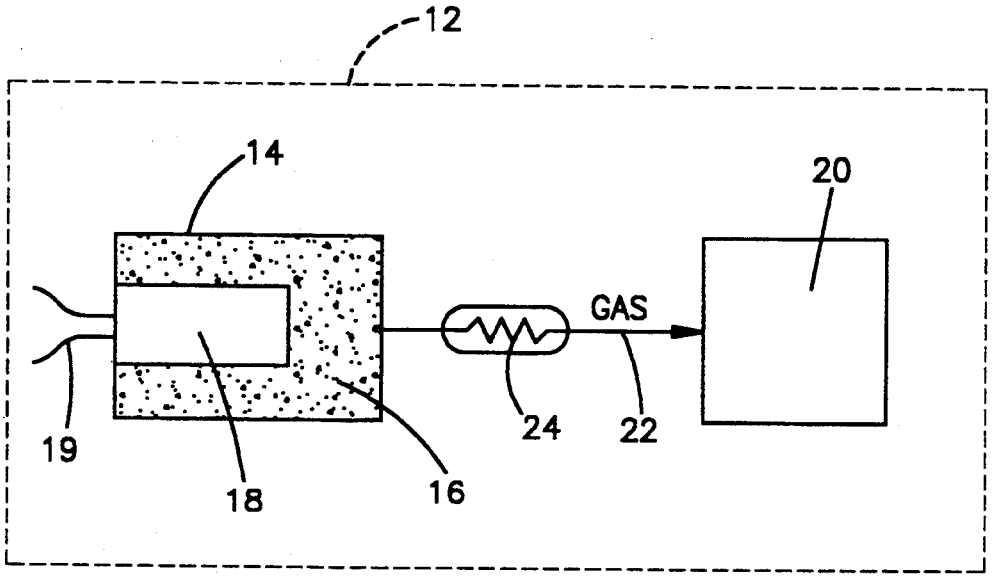
FIGURE

GAS GENERATOR FOR VEHICLE OCCUPANT RESTRAINT

BACKGROUND OF THE INVENTION

1. Technical Field

The present invention relates to a gas generator for a vehicle occupant restraint, such as an air bag, and to a gas generating composition which is used in the gas generator.

2. Description of the Prior Art

A large number of gas generating compositions have been proposed for generating gas to operate vehicle occupant restraints, such as air bags and pretensioners for seat belts. For air bags, in particular, compositions which produce an inert gas, such as nitrogen, have been preferred.

Excellent results have been achieved with solid nitrogen generating compositions which comprise an alkali metal azide fuel and one or more oxidizing agents for the fuel. Compositions comprising these materials produce, on combustion, a nitrogen gas along with other products of reaction.

One preferred oxidizing agent for an azide containing gas generating material is a metal oxide. A particularly preferred metal oxide is ferric oxide ($Fe_2O_3$). Ferric oxide is preferred because it is commercially readily available, less expensive than other metal oxides, and easier to work with when manufacturing gas generating material.

The form of ferric oxide which has been traditionally used, in combination with sodium azide, in the preparation of a gas generating composition for a vehicle occupant restraint, is alpha iron oxide. U.S. Pat. No. 4,902,036 discloses that this ferric oxide, though capable of a relatively high effective gas output, often requires the addition of a burn rate enhancer for a gas generating composition containing the oxidizer to reach its full potential.

U.S. Pat. No. 4,604,151 discloses data comparing the burning rate and heat of reaction of a sodium azide containing gas generating composition, in which the oxidizer is ferric oxide, with the same or a similar composition in which the oxidizer is nickel oxide ($NiO_2$) or copper oxide (CuO). Specifically, a composition having 65.5% sodium azide, 30% ferric oxide, and 4.5% ammonium perchlorate had a heat of reaction of 410 calories/gram and a burning rate, at 1,000 psi, of 1.30 in./sec. In contrast, a similar composition containing 30% nickel oxide had a heat of reaction of 456 calories/gram and a burning rate, at 1,000 psi, of 1.46 in./sec. A composition containing 61% sodium azide, 34.5% copper oxide, and 4.5% ammonium perchlorate, had a heat of reaction of 487.8 calories/gram and a burning rate, at 1,000 psi, of 2.24 in./sec.

U.S. Pat. No. 4,243,443 also discloses the reaction of ferric oxide with sodium azide. This patent specifically identifies $\alpha$-$Fe_2O_3$ as the iron oxide which was used. The patent discloses that one problem with this iron oxide is the reproducibility of burn characteristics from test to test. The patent proposes doping the ferric oxide with nickel, and discloses data showing a substantial improvement in burn rate of a composition containing a nickel doped ferric oxide over a composition containing an undoped ferric oxide.

U.S. Pat. No. 4,698,107 discloses applying an ignition enhancing coating to grains or pellets of a gas generating composition, which contains an alkali metal azide and ferric oxide. The coating contains ingredients which ensure a reliable ignition of the coating by an igniter. The burning of the ingredients of the coating provides a heat transfer to ignite the material of the gas generating grains or pellets.

Other ignition enhancing coatings are disclosed in U.S. Pat. Nos. 4,244,758, 4,246,051, and 4,390,380.

SUMMARY OF THE INVENTION

The present invention resides in a vehicle occupant restraint assembly. The assembly comprises an inflatable vehicle occupant restraint, a housing, a gas generating material within the housing, an igniter for igniting the gas generating material, and gas flow means for directing the gas which is generated into the vehicle occupant restraint. In a preferred embodiment of the present invention, the vehicle occupant restraint is an air bag. The gas generating material comprises an alkali metal azide, alkaline earth metal azide or aluminum azide and a metal oxidant which is the gamma form of ferric oxide ($Fe_2O_3$). The metal oxidant is present in the gas generating composition in an approximately stoichiometric amount with regard to the metal azide, or in an amount slightly in excess of stoichiometric.

The gas generating composition of the present invention can also comprise other ingredients which are well known in the art, such as binders, strengthening materials such as graphite or glass fibers, and combustion enhancers such as inorganic perchlorates and nitrates.

BRIEF DESCRIPTION OF THE DRAWINGS

Further features of the present invention will become apparent to those skilled in the art to which the present invention relates, from consideration of the following specification with reference to the accompanying drawing, in which:

The Figure is a schematic illustration of a vehicle occupant restraint assembly according to the present invention.

DESCRIPTION OF A PREFERRED EMBODIMENT

Referring to the Figure, the vehicle occupant restraint assembly 12 of the present invention comprises a housing 14. The housing 14 contains a gas generating composition 16. The gas generating composition 16 is ignited by an igniter 18 operatively associated with the gas generating composition 16. Electrical leads 19 convey current to the igniter 18 from an electric circuit that includes a power source and a sensor which is responsive to an event such as a vehicle collision. The assembly 12 also comprises a vehicle occupant restraint 20. A gas flow means 22 conveys gas, which is generated by combustion of the gas generating composition 16 within housing 14, to the vehicle occupant restraint 20. The gas flow means 22 may have cooling surfaces 24, for example, a plurality of mesh screens, to cool the gas. In addition to mesh screens, the cooling surfaces 24 can comprise filter surfaces for filtering particulate from the gas flow. Such filter surfaces function to cool the gas flow, as well as filter the gas flow.

A preferred vehicle occupant restraint is an air bag which is inflatable to restrain a vehicle occupant in the event of a collision. Other occupant restraints which can be used in the present invention are inflatable seat belts and seat belt pretensioners.

The present invention is not limited to a vehicle occupant restraint assembly of any particular configuration. One configuration suitable for use with the gas generating composition of the present invention is disclosed in U.S. Pat. No. 4,902,036 to Zander et. al. The assembly disclosed in this patent comprises means for positioning an air bag between an occupant of a vehicle and an interior portion of the vehicle, to protect the occupant from an impact with the interior portion of the vehicle, in the event of a collision involving the vehicle. The assembly can be installed in the steering wheel of the vehicle. A gas generator, including a housing, produces a sufficient quantity of gaseous combustion products to inflate the air bag. The housing has an igniter which is positioned axially within the housing. A gas generating composition is arranged in a doughnut-shaped configuration around the igniter. Upon ignition of the igniter, reaction products from the igniter ignite the gas generating composition.

A conventional igniter is shown in the Zander et. al. U.S. Pat. No. 4,902,036. This igniter comprises a squib. The squib contains a small charge of an ignitable combustible material. Electric leads convey a current to the squib. The current is provided when a sensor, responsive to an event such as a vehicle collision, closes an electrical circuit that includes a power source. The current generates heat which ignites the combustible material. The igniter also has a canister which contains a rapidly combustible material such as boron potassium nitrate. The rapidly combustible material is ignited by the small charge of combustible material. Ignition of the rapidly combustible material provides the threshold energy required to ignite the gas generating composition. Other ignition systems capable of producing this threshold energy are well known.

The gas generating composition 16, within the housing 14, can be in the form of a grain or pellet of any desired configuration. Examples of suitable configurations of a grain or a pellet are shown in U.S. Pat. No. 4,698,107 and also in the above-mentioned U.S. Pat. No. 4,902,036.

In U.S. Pat. No. 4,698,107, the grains have a generally disc-like configuration with a cylindrical exterior and an axially extending hole. The axially extending hole is designed to either receive an igniter, or the products of combustion of an igniter. A plurality of grains are arranged in a stacked relationship. All of the holes of the grains are aligned. Each grain has generally flat opposed surfaces and protuberances on such surfaces which space one grain slightly from another. Each grain also has a plurality of passages, parallel with the axially extending hole, but arranged in an annulus, or concentric annuli, about the axially extending hole. This configuration of the grains promotes uniform combustion of the gas generating material.

A somewhat similar configuration is shown in U.S. Pat. No. 4,902,036. The grains here have a generally toroidal, disc-like configuration, with a cylindrical exterior and an axially extending hole. A plurality of the grains are also arranged in a stack, so that all of the axially extending holes are aligned. An igniter fits within at least some of the grains, or is arranged to introduce products of combustion along the aligned holes of the grains, to ignite the grains.

It has also been proposed to press the gas generating composition into circular pellets shaped like an aspirin tablet. Such pellets have no holes or passages, but are arranged in a toroidal-shaped combustion chamber in a packed, but randomly oriented manner.

The grains of the present invention are made by blending the ingredients of the gas generating composition, and then pressing the blended ingredients into the desired configuration. Preferably, the grains are blended and pressed using a wet process. In this process, the ingredients are mixed with a liquid medium such as water or ethanol to form a slurry. The slurry may be partially dried, and then formed into the desired configuration using a press or compactor having such configuration. The formed grains are then dried. Alternatively, the gas generating material can be prepared using a dry process, wherein the ingredients of the gas generating composition are dry blended together, and then compacted into the desired configuration, while still in dry form.

The gas generating composition of the present invention comprises, as a major ingredient, an alkali metal azide or alkaline earth metal azide. A preferred alkali metal azide is sodium azide ($NaN_3$). Other alkali metal azides that can be used are potassium azide and lithium azide. Alkaline earth metal azides than can be used are azides of calcium, barium, strontium and magnesium. A metal azide such as aluminum azide can also be used.

The other major ingredient of the composition of the present invention is gamma iron oxide ($\gamma$-$Fe_2O_3$). Gamma iron oxide is the form of ferric oxide which comprises a cubic close-packed array of oxide ions with $Fe^{III}$ ions distributed randomly over both the octahedral and tetrahedral interstices. It is also known as "maghemite". It is obtained by careful oxidation of $Fe_3O_4$ (magnetite), or by heating one of the modifications of FeO(OH) (lepidocrocite). Powders of gamma iron oxide generally have a needle-like configuration, with a length of about 0.4–0.8 microns and an aspect ratio of 7–8:1. It has a melting point of about 1,470° C.–1,480° C. One of its primary uses is as the magnetic material for the manufacture of magnetic tape. Gamma iron oxide is available commercially from a number of sources. For instance, it is marketed by Miles, Inc. under the trademark "Bayferrox".

Traditionally, the iron oxide which has been used in a gas generating composition is alpha iron oxide. U.S. Pat. No. 4,243,443, as mentioned above, makes specific reference to alpha iron oxide, in columns 4 and 5 of the patent, and the problem of the reproducibility of burn characteristics from test to test with gas generating compositions containing alpha iron oxide as the oxidizer. The difficulties associated with alpha iron oxide in gas generating compositions have also been referred to in other patents, also as mentioned above. Examples are the disclosures of U.S. Pat. Nos. 4,902,036 and 4,604,151.

In the present invention, the inventor discovered that gamma iron oxide performed substantially differently than alpha iron oxide in a gas generating composition, and provided greater reliability in terms of ignition.

Preferably, the gamma iron oxide and metal azide are present, in the gas generating composition of the present invention, in an approximately stoichiometric ratio with respect to each other. More preferably, where the metal azide is sodium azide, the gamma iron oxide and sodium azide are present in a weight ratio of about 29%–40% gamma iron oxide to about 71%–60% sodium azide. At a weight ratio of about 29% gamma iron oxide to about 71% sodium azide, the gamma iron oxide and sodium azide essentially react according to the following equation:

$$6NaN_3+Fe_2O_3 \rightarrow 2Fe+3Na_2O+9N_2 \quad (1)$$

At a weight ratio of about 38% gamma iron oxide to about 62% sodium azide, which is a slight stoichiometric excess of gamma iron oxide to sodium azide, the gamma iron oxide and sodium azide essentially react according to the following equation:

$$4NaN_3+Fe_2O_3 \rightarrow (Na_2O)_2.\ FeO+6N_2+Fe \quad (2)$$

to give a double oxide of sodium and iron. In both of the reactions of equations (1) and (2) it is possible for some free sodium to form. When a stoichiometric excess of gamma iron oxide is present, in equation (2), e.g., about 40% gamma iron oxide, essentially no liquid sodium is formed in the reaction, similar to the teachings of U.S. Pat. No. 4,062,708.

The particle sizing of particles in the gas generating grains is not a critical aspect of the present invention. Broadly, it is preferred that the particles be within the range of about 10–20 microns in size. Gas generating compositions having particles less than about one micron may provide a burn rate or ignitability that is too rapid. Particles larger in size than about 20 microns may be nonignitable.

The composition of the present invention can contain other ingredients such as binders, graphite fibers, and burn rate enhancers. Bentonite is a suitable binder material. Preferred graphite fibers have an average diameter of 3–15 microns and a length of about 40–125 thousandths of an inch. Such graphite fibers provide added strength to the gas generating grains or pellets. Suitable burn rate enhancers are well known in the art, and include inorganic perchlorates and nitrates, such as potassium perchlorate, ammonium perchlorate, and sodium nitrate. A preferred gas generating composition of the present invention comprises, in addition to sodium azide and gamma iron oxide, about 0–5 weight percent bentonite and about 2–6 weight percent graphite fibers.

The following Example illustrates the present invention.

EXAMPLE

Two gas generating compositions were prepared. The first gas generating composition was identified as mix No. 123 and contained alpha iron oxide. The second gas generating composition was identified as mix No. 125 and contained gamma iron oxide. The alpha iron oxide was marketed by Harcross Pigments, Inc., under the trade designation K 416. The gamma iron oxide was marketed by Miles Inc., under the trademark "Bayferrox". The grade of gamma iron oxide used had the trade designation "PK 5210".

Both mixes 123 and 125 had the following composition:

| Ingredient | Percent by Weight |
|---|---|
| Iron oxide ($Fe_2O_3$) | 30.6 |
| Sodium azide | 57.4 |
| Bentonite | 4 |
| Sodium nitrate | 1.95 |
| Graphite fibers | 5 |
| Other | 1.05 |

The compositions were tested in a test inflator having a configuration similar to that disclosed in U.S. Pat. No. 4,902,036. The compositions were compressed into grains having a toroidal configuration similar to the grains of the '036 patent. The inflator was connected to a tank having a means for measuring pressure in the tank. Means were also provided to measure the burn time for the gas generating composition in the inflator and the heat of reaction in a PARR bomb. The heat of reaction is the number of calories generated per gram of gas generating composition.

Each composition was tested at three different ambient temperatures of −20° F., 70° F., and 150° F. At each temperature, three samples were tested. For each sample, a measurement was taken of tank pressure at three intervals, 0–40 milliseconds after ignition, 40–70 milliseconds after ignition, and 70–100 milliseconds after ignition. Burn time and heats of reaction were also taken.

The results are given in the following Table. The numbers under the heading "Inflator Results" are tank pressure measurement in psi. The numbers under the heading "Burn Time" are in milliseconds. The samples tested at each temperature are identified as 1st", 2nd", and "3rd".

TABLE 1

COMPARISON OF ALPHA IRON OXIDE vs GAMMA IRON OXIDE

| | | Inflator Results, Psi-Milliseconds | | | | | | | | | Burn Time, Milliseconds | | |
|---|---|---|---|---|---|---|---|---|---|---|---|---|---|
| | Mix | −20° F. | | | 70° F. | | | 150° F. | | | | | |
| Composition | Number | 1st | 2nd | 3rd | 1st | 2nd | 3rd | 1st | 2nd | 3rd | −20° F. | 70° F. | 150° F. |
| Composition | 123 | 117 | 677 | 1493 | 514 | 1728 | 2207 | 860 | 2242 | 2351 | 70.4 | 43.7 | 32.1 |
| with α-iron | | 145 | 853 | 1670 | 499 | 1728 | 2220 | 996 | 2294 | 2354 | 64.4 | 43.4 | 30.3 |
| oxide | | 152 | 752 | 1535 | 451 | 1639 | 2139 | 833 | 2227 | 2352 | 70.1 | 44.8 | 32.4 |
| | x = | 138 | 761 | 1566 | 488 | 1698 | 2189 | 896 | 2254 | 2352 | 68.3 | 44.0 | 31.6 |
| Composition | 125 | 219 | 1234 | 1834 | 925 | 2052 | 2030 | 1589 | 2321 | 2238 | 48.5 | 30.9 | 20.2 |
| with γ-iron | | 150 | 1147 | 1877 | 880 | 2068 | 2087 | 1501 | 2285 | 2210 | 46.5 | 31.2 | 21.1 |
| oxide | | 233 | 1324 | 1873 | 856 | 2048 | 2084 | 1501 | 2352 | 2306 | 46.5 | 30.6 | 21.5 |
| | x = | 201 | 1235 | 1861 | 887 | 2056 | 2067 | 1530 | 2319 | 2251 | 47.2 | 30.9 | 20.9 |

At the bottom of each column, average pressure values are given to the right of the designation marked "X".

As can be seen from Table 1, the gamma iron oxide gave substantially improved tank pressure measurements. For instance, at 70° F., the alpha iron oxide containing composition had average tank pressure readings of 488 and 1698 psi, for the intervals of 0–40 and 40–70 milliseconds, whereas the gamma iron oxide, at the same ambient temperature and intervals, gave readings of 887 and 2056 psi. The other pressure readings given in the above Table were correspondingly better for the gamma iron oxide containing composition.

In addition, it can be seen that at 70° F., the alpha iron oxide containing composition had an average burn time of 44 milliseconds, whereas the gamma iron oxide containing composition had an average burn time of 30.9 milliseconds. An improvement of 10 milliseconds burn time is considered to be substantial.

The heats of reaction for the respective compositions were also determined. The alpha iron oxide containing composition gave an average heat of reaction of 328 calories per gram, whereas the gamma iron oxide containing composition gave an average heat of reaction of 356 calories per gram. An increase of about 30 in the heat of reaction is also considered to be significant.

From the above data, it can be seen that gas generating compositions containing gamma iron oxide are significantly better performing. Further, it was found that the compositions containing gamma iron oxide offered the same processing advantages as a composition containing alpha iron oxide.

From the above description of the present invention, those skilled in the art will perceive improvements, changes and modifications. Such improvements, changes and modifications, within the skill of the art, are intended to be covered by the appended claims.

Having described the invention, the following is claimed:

1. A vehicle occupant restraint assembly comprising:

(a) a vehicle occupant restraint;

(b) a housing;

(c) a gas generating composition within the housing;

(d) an igniter for igniting the gas generating composition; and (e) gas flow means for directing gas from said housing to said vehicle occupant restraint;

said gas generating composition comprising a metal oxidant and a metal azide selected from the group consisting of an alkali metal azide, an alkaline earth metal azide, and aluminum azide, wherein the metal oxidant is gamma iron oxide.

2. The restraint assembly of claim 1 wherein said gamma iron oxide and said metal azide are in the gas generating composition in approximately a stoichiometric ratio.

3. The restraint assembly of claim 2 wherein said metal azide is sodium azide and said gas generating composition comprises gamma iron oxide and sodium azide in the weight ratio of about 29:71 to 40:60 gamma iron oxide to sodium azide.

4. The restraint assembly of claim 3 wherein in the gas generating composition comprises a slight stoichiometric excess of gamma iron oxide and the gamma iron oxide and sodium azide react essentially according to the equation:

$$4NaN_3+Fe_2O_3\rightarrow(Na_2O)_2\cdot FeO+6N_2+Fe$$

5. The restraint assembly of claim 1 in which said gas generating composition also contains a burn rate enhancer.

6. The restraint assembly of claim 1 wherein said gas generating composition is in the form of grains or pellets.

7. The restraint assembly of claim 1 in which said vehicle occupant restraint is an air bag.

* * * * *